US005941496A

United States Patent [19]

Banner

[11] Patent Number: 5,941,496

[45] Date of Patent: Aug. 24, 1999

[54] FOLDING MUSIC OR COPY STAND

[76] Inventor: Daniel Martin Banner, 120 4th St., Petaluma, Calif. 94952

[21] Appl. No.: 08/825,176

[22] Filed: Mar. 27, 1997

[51] Int. Cl.[6] ..... A47B 97/04

[52] U.S. Cl. ..... 248/459

[58] Field of Search ..... 248/459, 454, 248/455, 456, 460, 174; 40/124.09, 124.16, 124.17, 124.191

[56] References Cited

U.S. PATENT DOCUMENTS

| | | | |
|---|---|---|---|
| 1,840,659 | 1/1932 | Eburne et al. | 248/456 |
| 2,204,881 | 6/1940 | Belleisle | 248/459 |
| 2,375,190 | 5/1945 | Botts | 281/33 |
| 2,474,659 | 6/1949 | Ebert | 248/459 |
| 2,533,874 | 12/1950 | Burr | 248/459 |
| 2,559,489 | 7/1951 | Wolf | 40/126 |
| 2,803,076 | 8/1957 | Viglietta | 248/459 |
| 2,992,500 | 7/1961 | Hay Hen | 248/459 |
| 3,473,777 | 10/1969 | Ketterer | 248/459 |
| 3,785,605 | 1/1974 | Parekh | 248/455 |
| 3,990,669 | 11/1976 | Smith | 248/459 |
| 3,991,967 | 11/1976 | Sack | 248/448 |
| 4,318,527 | 3/1982 | Smith | 248/459 |
| 4,460,146 | 7/1984 | Raggiotti | 248/456 |
| 4,555,128 | 11/1985 | White | 248/456 |
| 4,610,416 | 9/1986 | Choi | 248/459 |
| 4,722,504 | 2/1988 | Degenholtz | 248/459 |
| 5,029,798 | 7/1991 | Clark | 248/459 |
| 5,035,393 | 7/1991 | Menaged | 248/456 |
| 5,141,199 | 8/1992 | Nemeth | 248/455 |
| 5,165,649 | 11/1992 | Neumann | 248/459 |

*Primary Examiner*—Derek J. Berger
*Assistant Examiner*—Anita M. King
*Attorney, Agent, or Firm*—Larry D. Johnson

[57] ABSTRACT

A lightweight, folding music stand is provided which is also of use as a copy holder or a book holder. The stand is comprised of a plurality of panels and hinges arranged such that the stand is folded or erected with a minimum of steps and with desirable rigidity. The stand is also returned to a folded position with minimal effort and with a minimum of steps. The plurality of panels and hinges form a support member, a shelf, an angular portion, and feet members when the stand is in its operation configuration. The angular portion and feet members are integrally formed. When closed, the support member and shelf fold to form two panels and the device folds to approximately one-half the size of the support member. The folding support member encloses the feet members which nest within the closed stand. In its closed configuration, the stand is smaller and lighter in weight than a typical magazine, and consequently can be easily transported and stored.

2 Claims, 3 Drawing Sheets

FOLDING MUSIC OR COPY STAND

FIELD OF THE INVENTION

Numerous devices exist for the support of reading material in an open and substantially upright position. The purposes of the devices are well known in the art. Musicians, students and other users are required to travel extensively to work and rehearse away from the home or office. Many of the known devices are designed to fold for ease of transport and storage. However, previous devices are deficient in many ways. The subject invention is designed to suit the many purposes of such a device, to be of desirable rigidity and to be both easy to use, transport and store.

The devices in the prior art (such as U.S. Pat. No. 5,029,798) have numerous steps in the assembly (unfolding) process, while an embodiment of this stand can be opened in one continuous motion or three separate steps and without requiring the attachment or removal of parts. Many of the stands in the prior art are bulky and heavy even when disassembled. In the present invention, no removal or attachment of separate parts is required. No separately operating parts must be manipulated. All of the parts are integrally formed and all moving parts operate in coordination with one another. Prior devices have several more component parts and may require tools for assembly and disassembly. The subject invention's component parts are designed to interact in such a way as to keep the number of parts to a minimum. Additionally, due to the materials used and the design of the invention, when the stand is in its closed position, it is smaller and lighter in weight than a typical magazine, and consequently can be easily transported and stored.

An added challenge of devices in the area is the need for a support member which is rigid enough and large enough to support a book yet which folds to a size which is convenient for transport. The subject invention achieves these objectives in a superior fashion to the devices in the prior art. The support member is sufficiently wide and tall when the stand is in its operational configuration. When in the closed configuration, the support member folds substantially in half. The other components of the stand fold to be nestled between the halves of the support member. In the closed configuration, the area of the device is merely half the area of the support member and the thickness is merely equivalent to four panels placed on top of one another. And the outside surface of the device in the closed configuration is the smooth, continuous surface of each half of the support member, with the smaller members enclosed between each half.

DETAILED DESCRIPTION OF THE INVENTION

Figure 1:
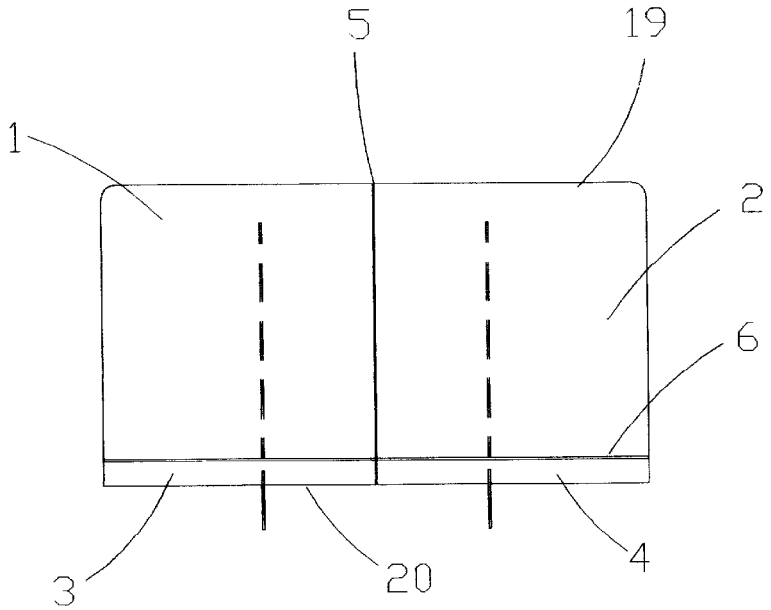
FIG. 1 is a front view of the simplest embodiment of the invention in the operational configuration.

In its simplest embodiment, the invention can be constructed of four panels, two wing-like portions which integrally form the feet and the angular portions which determine the angle at which the stand rests when open, and two flexible hinges. (Alternatively, the stand could be made of four or more non-flexible hinges.) Two of the panels are the largest portions of the stand. They can be of varying size, but are probably most advantageously sized somewhat less than an 8½"×11" sheet of paper. The two largest panels are joined to one another by a hinge along one contiguous edge. The other two panels are of much smaller dimension, being of substantially the same width as the first two panels but of only in the neighborhood of 1–2 inches in length. Each of these third and fourth panels is joined to the first and second panels by a hinge along a contiguous edge that is of comparable dimension to the first and second panels. These third and fourth panels are also joined to one another by a hinge which is contiguous with the hinge which adjoins the first and second panels. As such, the first hinge continues the length of both the first and second panels and the third and fourth panels. The device is closed completely along this hinge. The hinge adjoining the third and fourth panels to the first and second panels is perpendicular to the first hinge and operates in the direction perpendicular to that of the first hinge to allow the shelf to be put in place for use after the device is opened.

As illustrated in FIGS. 1–4, the first two panels (1 and 2), when the device is opened along the first hinge (5), form the support member (19) of the invention. The third and fourth panels (3 and 4) form the shelf member (20). When the device is opened along the first hinge, all of the panels lie in the same plane. The second hinge (6) can then be operated to swing the shelf member into place at substantially a right angle to the support member. The operation of the second hinge in the direction perpendicular to that of the first hinge and the fact that the two are perpendicular to one another prevents the hinges from operating at the same time and serves to rigidify the device. When the shelf member is swung into position, the device cannot close.

Figure 2:
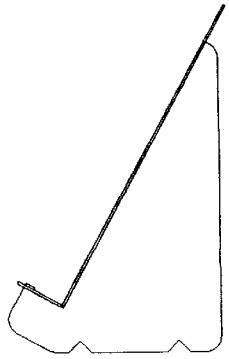
FIG. 2 is a side view of the same embodiment in the operational configuration.
Figure 3:
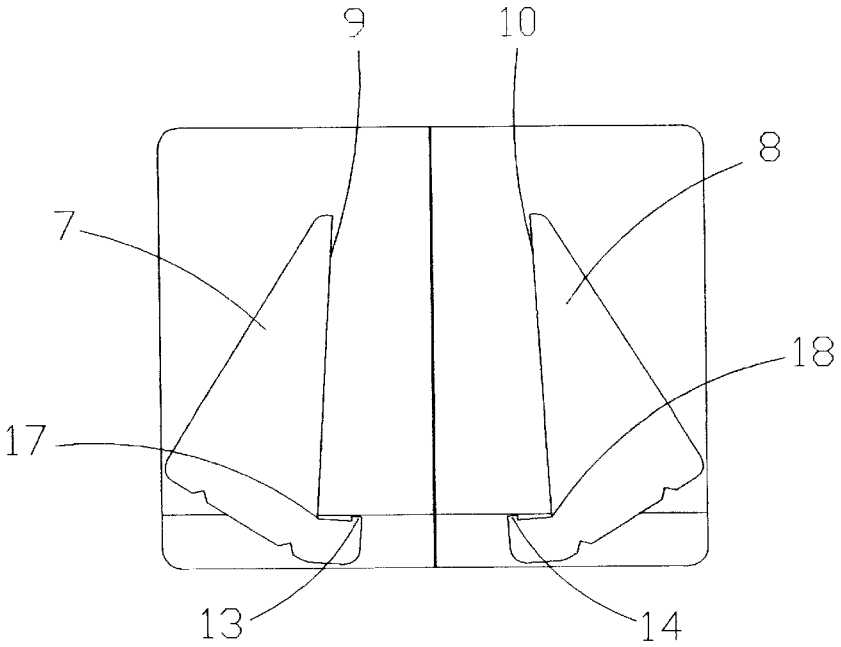
FIG. 3 is a rear view of the simplest embodiment opened along the first hinge but not yet placed in the operational configuration. In this figure, the shelf member and feet have not been placed in the operational configuration.
Figure 5:
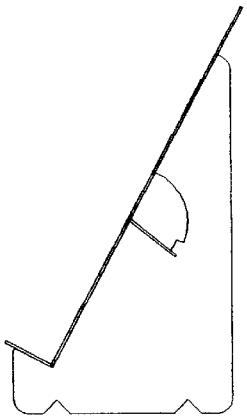
FIG. 5 is a side view of the same embodiment in the operational configuration.

The feet members (7 and 8) are affixed to the back side surfaces of the support member panels via a third and fourth hinge (9 and 10). FIGS. 2 and 5 illustrate notches formed in the feet members which are utilized to adjust the angle of these embodiments of the device when it is in use. The stand can be tilted and adjacent notches in each foot member placed against a book or similar object such that the stand will remain tilted. (As an alternative embodiment, a retractable arm or strut and rounded feet serve to adjust the angle of the stand at the desire of the user). The feet members form angular portions (17 and 18) which support the angle of the shelf member to the support member, feet members (7 and 8) which stabilize the device along its back side, and upon which the device rests upon a table top or other surface. The feet members are of such dimensions that the feet are disposed within the stand when the stand is in the closed position and extend below the shelf member when the shelf member is swiveled about the second hinge to be placed perpendicular to the support member.

The feet also have tabs (13 and 14) which engage with notched portions (not pictured) cut into the shelf. These stabilize the device in its open position.

To return the stand to its closed position, the tabs are disengaged from the notches, the feet are folded into the plane of the support member, and the shelf is returned to the plane of the support member. The stand can now be closed along the center line, nestling the feet between the two panels to which they are affixed.

Another embodiment illustrated in FIGS. 7–10 incorporates notched feet members and an additional set of panels (15 and 16) forming a stabilizing member. The stabilizing member is adjoined to the support member via a sixth hinge (23). This set of panels has tabs (25 and 26) which can adjustably engage the notches in the feet members (21 and 22), thereby allowing the user to adjust the angle of the stand to the surface on which it is placed. In the preferred embodiment, the notches and tabs are interlocking for desired stability.

Figure 4:
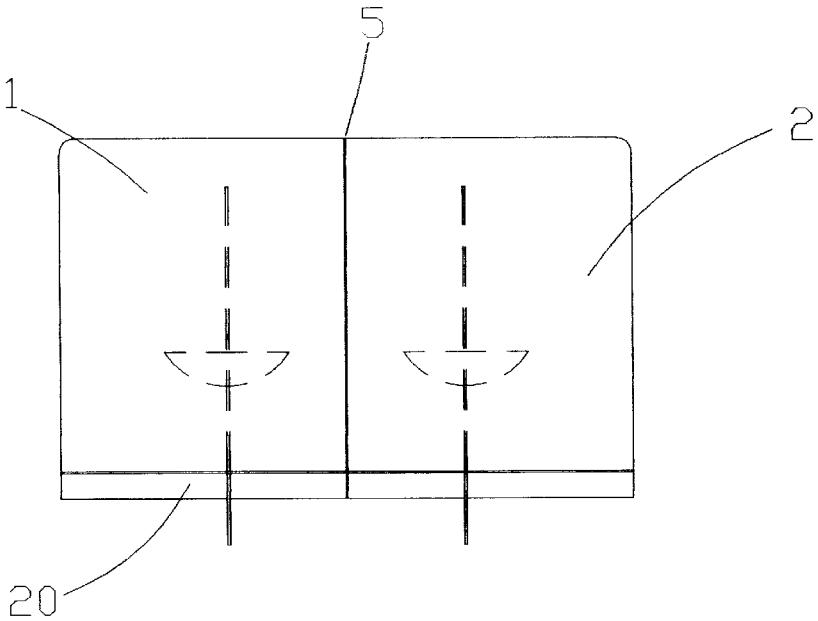
FIG. 4 is a front view of another embodiment of the invention in the operational configuration.
Figure 6:
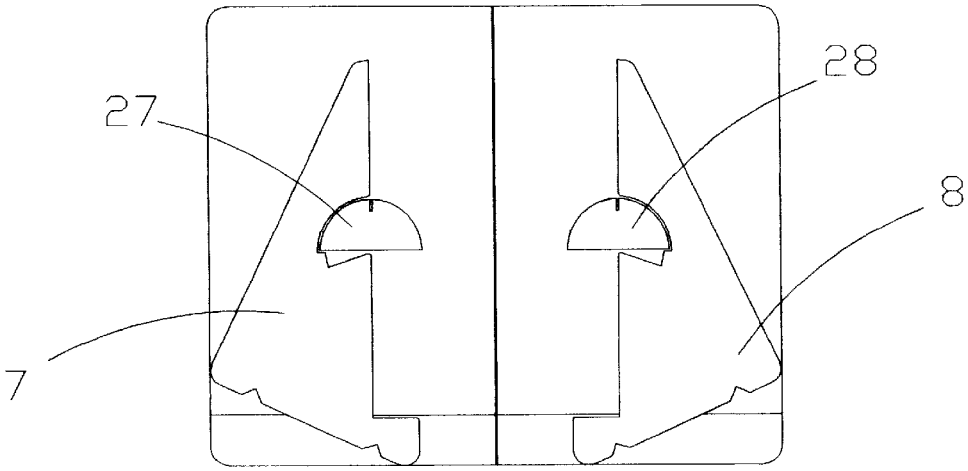
FIG. 6 is a rear view of this embodiment opened along the first hinge. In this figure the shelf member and feet have not yet been placed in the operational configuration.
Figure 7:
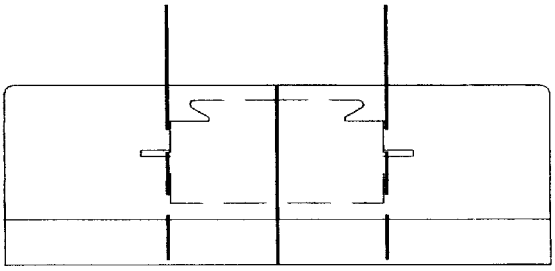
FIG. 7 is a view from the top of another embodiment of the invention.
Figure 8:
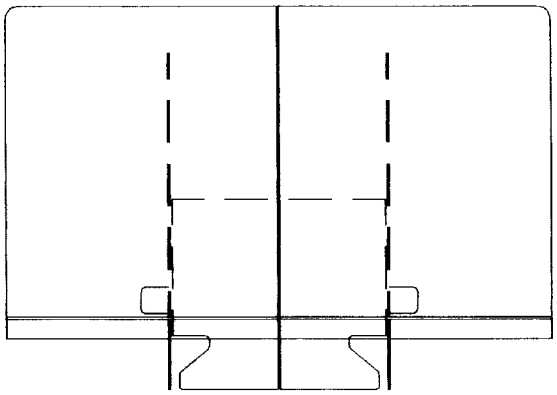
FIG. 8 is the front view of this third embodiment in the operational configuration.
Figure 9:
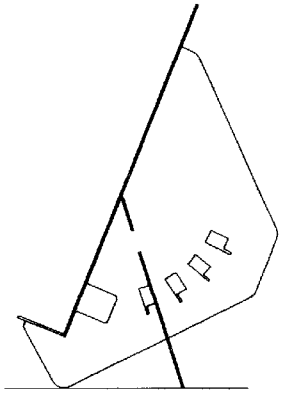
FIG. 9 is a side view of this embodiment in the operational configuration.
Figure 10:
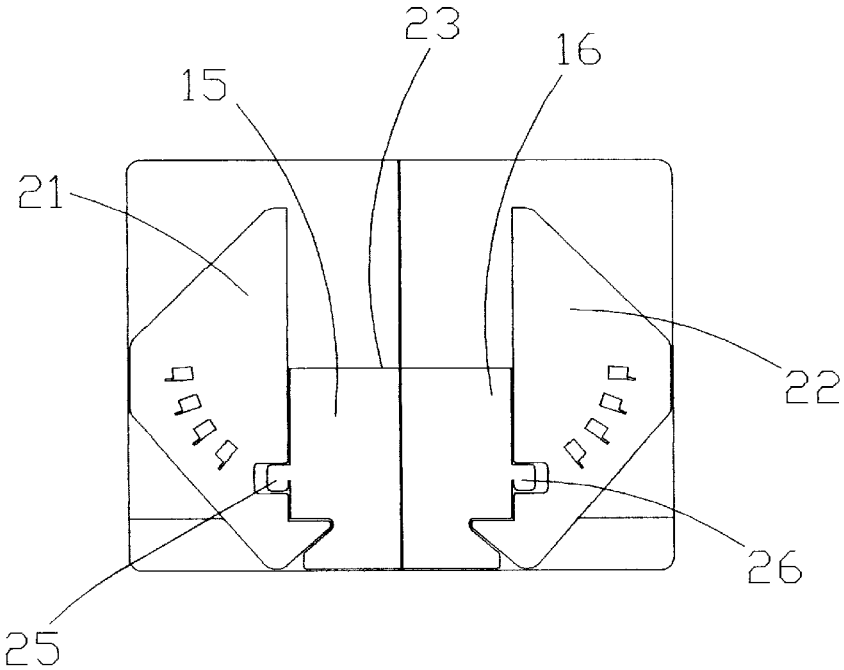
FIG. 10 is a view of the back of this embodiment with the support member in the open, but none of the other members in the operational configuration. The shelf member and feet members are lying in the same plane as the support member and have not been placed in the operational configuration.

The embodiment illustrated in FIGS. 4–6 is similar to the simplest embodiment with the added features of half-moon stabilizing members 27 and 28 instead of tabs and notches. These stabilizing members lie in the plane of the support member when the stand is not in use. When the stand is in use, the stabilizing members, feet members, and support member are all substantially perpendicular to one another, thereby constituting the three dimensional configuration of the stand.

Preferable materials include lightweight, semirigid thin sheeted plastic or aluminum. Other lightweight materials, such as cardboard, may be used, but are less desirable for long term use.

Any light source known in the art may be attached to the stand to furnish light to the user.

It is understood that the described embodiments are intended solely as descriptions of the preferred embodiments and as illustrative of the general principles of the invention. The embodiments described are not intended to limit the scope of the claims. The scope of the invention should be determined with reference to the appended claims along with their full scope of equivalents.

I claim:

1. A stand for use upon a surface comprising:

first and second panels, the first and second panels each comprising a front side, a back side, an inner edge and a bottom edge;

a first flexible hinge, said first and second panels adjoined along their respective inner edges via the first hinge;

an operational configuration and a closed configuration;

a support member comprised of the first and second panels and the first hinge, the first and second panels contiguous and lying in the same plane when the stand is in the operational configuration, the back side of the first panel facing the back side of the second panel when the stand is in the closed configuration;

third and fourth panels, said third and fourth panels each having a top side, a bottom side, an inner edge and an upper edge, said third and fourth panels adjoined to one another along their respective inner edges via the first hinge, the third and fourth panels substantially coplanar with the first and second panels respectively when the stand is in the closed configuration;

a second flexible hinge adjoining the upper edges of the third and fourth panels to the bottom edges of the first and second panels, said second hinge operating in a direction perpendicular to that of the first hinge such that the first and second hinge cannot operate at the same time;

a shelf comprised of the third and fourth panels and second hinge, the shelf in pivotal relationship to the support member when the support member is opened along the first hinge, the shelf substantially perpendicular to the support member when the stand is in the operational configuration;

a first and second foot member;

a third and a fourth hinge;

said first foot member affixed to the back side of the first panel via the third hinge and said second foot member affixed to the back side of the second panel via the fourth hinge, said first and second foot member in the same plane as the first and second panels when the stand is in the closed configuration and substantially perpendicular to the first and second panels when the stand is in the operational configuration;

a first and second angular portion, said first angular portion formed integrally with said first foot member, said second angular portion formed integrally with said second foot member, said angular portions of substantially a 90 degree angle, said angular portions positioned at less than a 90 degree angle to the horizontal such that the front side of the support member is at an approximate 90 degree angle to the shelf and the back side of the support member is less than 90 degrees to the horizontal and the bottom side of the shelf is less than 90 degrees to the surface on which the device rests and the shelf and the support member rest within the angular portions when the stand is in the operational configuration at an angle which is desirable for supporting materials;

a first and second tab, said tabs integrally formed with the first and second foot member respectively;

a first and second notch formed within the third and fourth panels respectively, said tabs engaging said notches when the stand is in the operational configuration such that the shelf is maintained at a substantially 90 degree angle to the support member when the stand is in use.

2. A stand for use upon a surface comprising:

first and second panels, the first and second panels each comprising a front side, a back side, an inner edge and a bottom edge;

a first flexible hinge, said first and second panels adjoined along their respective inner edges via the first hinge;

an operational configuration and a closed configuration;

a support member comprised of the first and second panels and the first hinge, the first and second panels contiguous and lying in the same plane when the stand is in the operational configuration, the back side of the first panel facing the back side of the second panel when the stand is in the closed configuration;

third and fourth panels, said third and fourth panels each having a top side, a bottom side, an inner edge and an upper edge, said third and fourth panels adjoined to one another along their respective inner edges via the first hinge, the third and fourth panels substantially coplanar with the first and second panels respectively when the stand is in the closed configuration;

a second flexible hinge adjoining the upper edges of the third and fourth panels to the bottom edges of the first and second panels, said second hinge operating in a direction perpendicular to that of the first hinge such that the first and second hinge cannot operate at the same time;

a shelf comprised of the third and fourth panels and second hinge, the shelf in pivotal relationship to the support member when the support member is opened along the first hinge, the shelf substantially perpendicular to the support member when the stand is in the operational configuration;

a first and second foot member comprising a plurality of notches;

a third and a fourth hinge; said first foot member affixed to the back side of the first panel via the third hinge and said second foot member affixed to the back side of the second panel via the fourth hinge, said first and second foot member in the same plane as the first and second panels when the stand is in the closed configuration and substantially perpendicular to the first and second panels when the stand is in the operational configuration;

a first and second angular portion, said first angular portion formed integrally with said first foot member, said second angular portion formed integrally with said second foot member, each said angular portions of substantially a 90 degree angle, said angular portions positioned at less than a 90 degree angle to the horizontal such that the front side of the support member is at an approximate 90 degree angle to the shelf and the back side of the support member is less than 90 degrees to the horizontal and the bottom side of the shelf member is less than 90 degrees to the surface on which the device rests and the shelf and the support member rest within the angular portions when the stand is in the operational configuration at an angle which is desirable for supporting materials;

fifth and sixth panels, said fifth and sixth panels comprising inner edges, outer edges and upper edges, the outer edges comprising one or more tabs; a fifth hinge adjoining the fifth and sixth panels along their respective inner edges;

a stabilizing member comprising the fifth and sixth panels and fifth hinge;

a sixth hinge pivotally adjoining the stabilizing member to the back side of the support member such that the stabilizing member can be rotated out of the plane of the support member and the tabs can be inserted into the notches of the feet members when the stand is in the operational configuration, the plurality of notches arranged to receive the tabs at variable positions of the stabilizing member, thereby stabilizing the stand in the open position at variable angles to the horizontal.

* * * * *